United States Patent [19]

Robinson

[11] 4,453,359

[45] Jun. 12, 1984

[54] BUILDING WALL PANEL

[75] Inventor: Ralph C. Robinson, Redmond, Wash.

[73] Assignee: Olympian Stone Company, Inc., Redmond, Wash.

[21] Appl. No.: 375,813

[22] Filed: May 7, 1982

[51] Int. Cl.[3] ..... E04C 2/22

[52] U.S. Cl. ..... 52/389

[58] Field of Search ..... 52/513, 506, 385, 389, 52/601, 508, 384

[56] References Cited

U.S. PATENT DOCUMENTS

| | | | |
|---|---|---|---|
| 1,437,114 | 11/1922 | Maze | 52/385 |
| 2,241,338 | 5/1941 | Balduf . | |
| 3,299,601 | 1/1967 | Chiville . | |
| 3,605,366 | 9/1971 | Zakim | 52/513 |
| 3,724,152 | 4/1973 | Castellarin . | |
| 3,885,008 | 5/1975 | Martin . | |
| 3,965,635 | 6/1976 | Renkert | 52/434 |
| 4,045,933 | 9/1977 | Grillo | 52/513 |
| 4,185,437 | 1/1980 | Robinson . | |
| 4,223,502 | 9/1980 | Robinson . | |

FOREIGN PATENT DOCUMENTS

| | | | |
|---|---|---|---|
| 1294513 | 4/1962 | France | 52/389 |

OTHER PUBLICATIONS

"Marble-Faced Precast Panels", National Association of Marble Producers, (1966), pp. 1-6 and 22.

"PCI Manual for Structural Design of Architectural Precast Concrete", Prestressed Concrete Institute, (1977), pp. 9-2 to 9-13.

"Glass Fiber Reinforced Concrete Products-Properties and Applications", Article by John Jones & Thomas P. Lutz from Journal of Prestressed Concrete Institute, vol. 22, No. 3, May-Jun. 1977, pp. 2-25.

*Primary Examiner*—James L. Ridgill, Jr.

*Attorney, Agent, or Firm*—Christensen, O'Connor, Johnson & Kindness

[57] ABSTRACT

A building wall panel (20) adapted for mounting on a building frame includes an exterior facing formed from a plurality of thin stone panels (22) of for instance granite or marble, backed and interconnected by a layer (28) of glass fiber-strengthened concrete underlying the panels and covering and engaging anchor clips (24) secured to the backs of the stone panels (22). The backing layer (28) is bonded to a metal support frame (30) by additional amounts of glass fiber-reinforced concrete (29) overlaying portions of anchor members (36) carried by the support frame and adjacent portions of the backing layer (28). A method of forming the building wall panel (20) involves placing granite or marble panels (20) face down in a form (48), mounting anchor clips (24) or pins (61) in the backs of the stone panels, and spraying a layer of slurry (55) formed from a mixture of concrete and chopped glass fiber strands, over both the panels (22) and the anchor clips (24) or pins (61). A metal wall panel support frame (30) is placed over the backing layer (28) so that anchor members (36) carried by the frame (30) abut the backing layer (28). Next, additional amounts (29) of the slurry (55) are applied over the anchor members (36) and adjacent portions of the backing layer (28).

21 Claims, 12 Drawing Figures

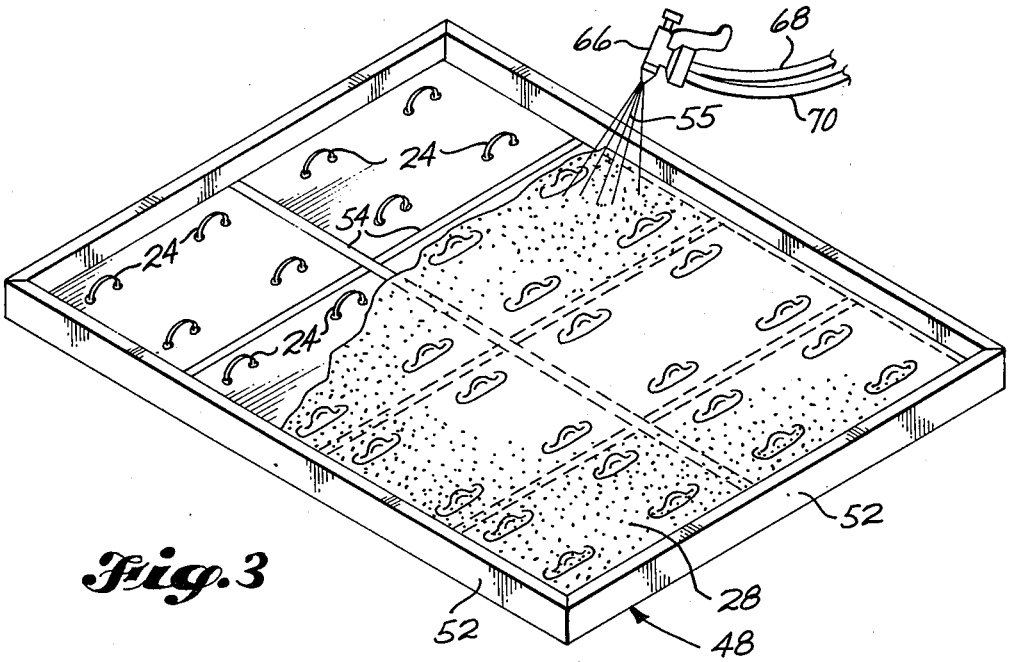
Fig. 3
Fig. 4
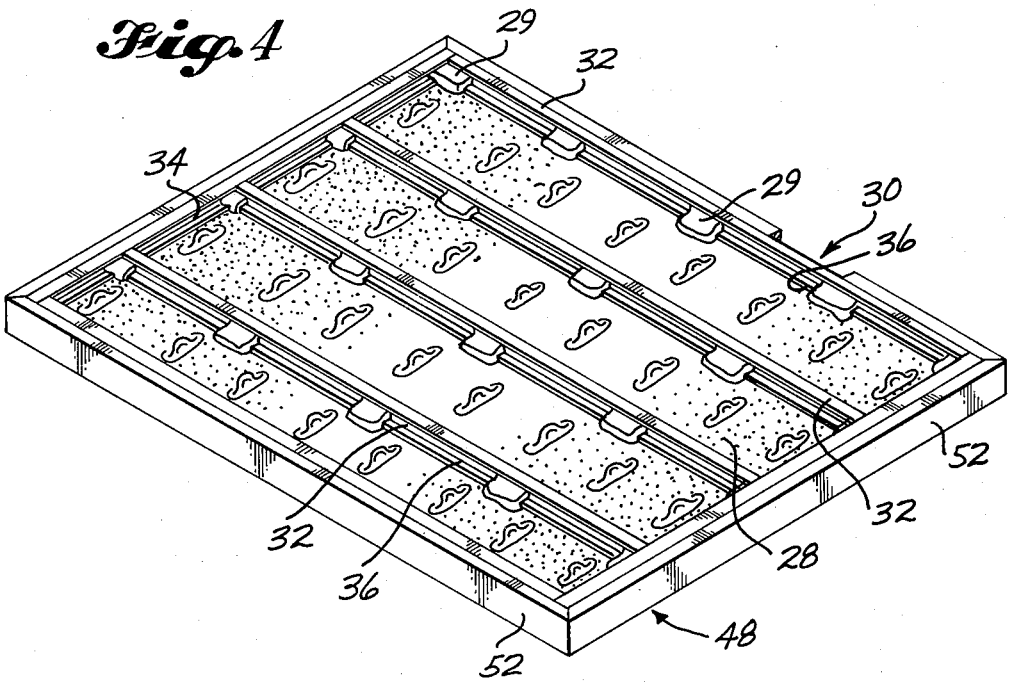

Fig. 5
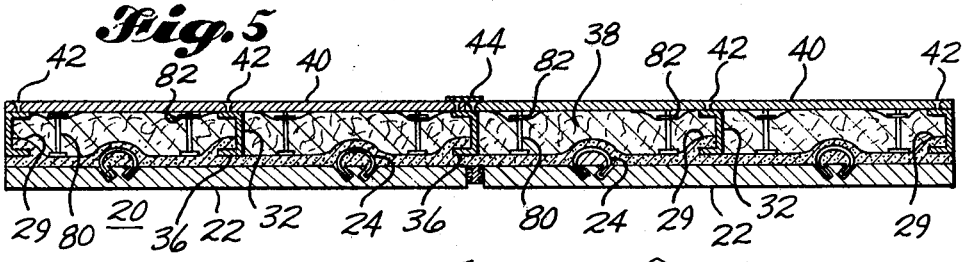
Fig. 8
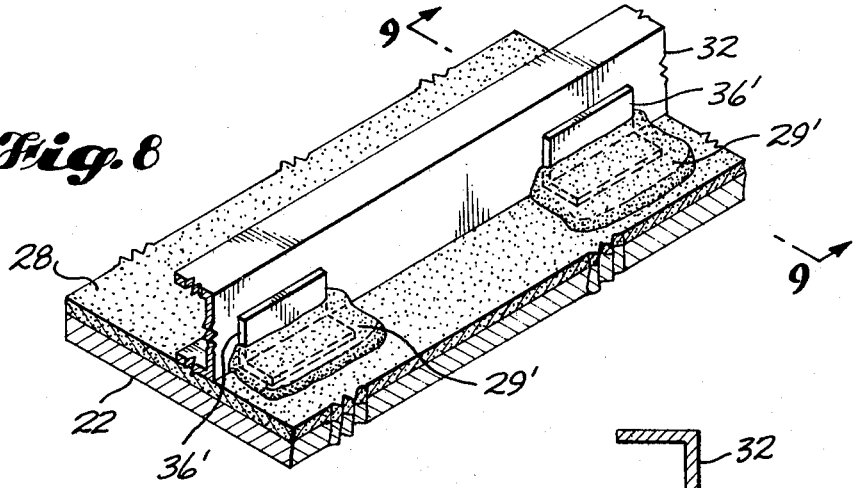
Fig. 9
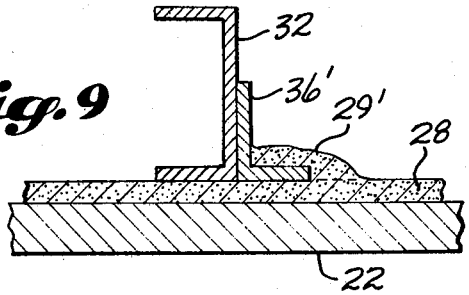
Fig. 10
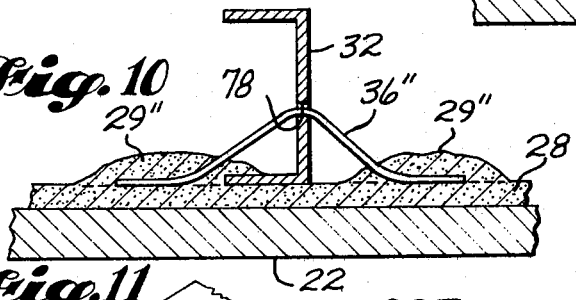
Fig. 11
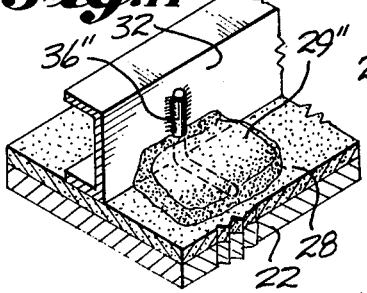
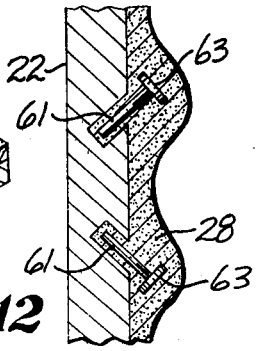
Fig. 12
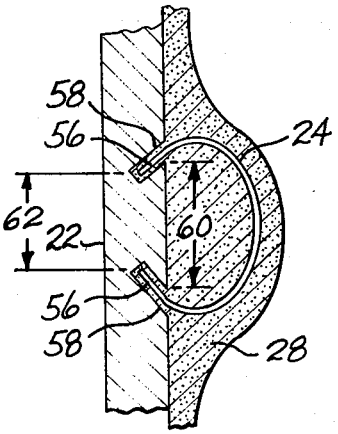
Fig. 7

BUILDING WALL PANEL

FIELD OF THE INVENTION

The present invention relates generally to the building wall panel art, and more particularly to the composition, manufacture and mounting on buildings of a framed wall panel having an exterior facade formed from thin panels of granite or marble.

BACKGROUND ART

Granite and marble are considered to be highly desirable architectural materials for forming the exterior facade or facing of building structures, such as a skyscraper. These materials are not only highly pleasing in appearance, but also very durable and require only a minimum of maintainance. This is borne out by the many marble or granite faced buildings throughout the world which were constructed hundreds of years ago and are still in use today. However, the scarcity of marble relative to the current demand and the unprecedented rise in the cost of construction labor has drastically increased the cost of constructing buildings faced with marble or granite.

In an early construction method, still used today, selected pieces of facing material of marble or granite were hand set directly on the structural steel skeleton or concrete frame of a building. The panels were held in place by bolts or similar hardware. In this type of construction, the panels of the stone facing material must be at least several inches thick to have the strength necessary to support their own weight without cracking. These thick panels are not only very costly to quarry and cut to size, but also are difficult to handle if made in a desirably large size to cover a building surface at a reasonable rate. If the height and width of the panels are decreased to make them easier to handle, an increased number of panels are needed to cover the building surface thereby increasing the number of time-consuming panel mounting operations required.

Once the marble or granite facade has been attached to the steel or concrete frame or backing, a separate interior wall must be erected. Modern fire codes for commercial structures typically prohibit the use of flame-transmitting materials in the construction of the building walls. In addition, building codes now require that exterior walls be insulated to minimize heat loss in the winter and heat gain in the summer.

Other methods of attaching a granite or marble facing material to a building include that shown in U.S. Pat. No. 3,299,601, wherein C-shaped clips are inserted within openings drilled in the rear surface of marble slabs. Thereafter, a layer of dense cementatious material is spread over the rear faces of the slabs. Before the cementatious layer sets up, a sheet of wire mesh and a frame composed of a metallic corrugation surrounded by channel members are placed over the dense cementatious material. Next, a porous cementatious, second layer is applied over the first dense layer and around the corrugations to completely fill the envelope defined by the corrugations and the surrounding channel members. One drawback of this particular construction is that because the space between the corrugations is entirely filled with cementatious material, insulating material, such as rock wool or glass fiber, must be placed behind the wall panel resulting in a relatively thick structure. Moreover, a separate inside wall must be provided.

A further method of attaching a granite or marble facing to a building is disclosed by U.S. Pat. No. 3,724,152, which includes backing the selected architectural grade facing material with a supporting member of suitable hard stone, such as marble or granite, and then backing this hard stone with a layer of conventional concrete. The facing material, backing stone and concrete are then attached to the building structure by suitable fasteners, such as bolts. In this method, although relatively thin panels of facing material were used, the stone and concrete backing is required to provide sufficient structural integrity to mount the facing material without cracking.

U.S. Pat. No. 4,223,502 concerns a building wall panel adapted to be mounted on a building structure to form at least a portion of the outer walls of the structure. The building panel includes a plurality of granite or marble panels with pairs of holes drilled in their rear sides for receiving C-shaped anchor clips. A layer of glass fiber reinforced concrete is sprayed over the back surfaces of the granite or marble panels and around the anchor clips to connect the panels to the concrete backing layer. A drawback of this particular construction is that the wall panel only serves as an exterior facade for the building thereby necessitating a separate inner wall structure which also must be attached to the building frame. Moreover, building panels constructed in this manner are limited to a maximum length of approximately fifteen feet. To reduce building costs, it is desirable that structural panels be substantially larger in size, for instance in the range of thirty feet in length or more.

French Pat. No. 2,304,742 discloses a prefabricated building wall unit composed of ceramic panels or blocks which are set within a backing layer of cement mortar reinforced with fiberglass. As in the above-discussed U.S. Pat. No. 4,223,502 patent, there is a limitation as to the maximum size in which this type of building unit may be made and still safely support the ceramic blocks.

A wall panel having finished plaster surfaces on both sides is shown by U.S. Pat. No. 2,241,338 as including a facing of plasterboard or gypsum board secured to one side of a frame formed from a plurality of metal studs. A layer of plaster overlays the plasterboard on both sides of the frame. The disclosed structure is not well adapted to prefabrication as the plasterboard is attached to the metal frame after the metal frame is secured within a building. In addition, the layers of plaster are applied to the plasterboard after the partition is in place, thereby requiring time-consuming, on sight fabrication to produce the finished partition.

U.S. Pat. No. 3,885,008 discloses a wall section composed of an external, molded panel bonded to a wooden frame. The external wooden panel is formed from comminuted earthen and plastic materials and is attached to the wooden frame by overlying the entire back surface of the molded panel and the sides of adjacent wooden frame members with a layer of fiberglass reinforced plastic. This wall panel has inherent structural as well as durability limitations. For example, the external molded plastic panel is subject to cracking and separation from the underlying wooden frame when exposed to the tensile and twisting forces occuring in a multi-story structure. In addition, the inherent structural weakness of the underlying wooden frame generally prohibits prefabricating a wall panel into a single, large multi-story unit. Also, the plastic exterior molded panel, the bonding compound securing the molded panel to the wooded frame, and the wooden frame itself are all flamable materials which would not satisfy fire codes for commercial structures.

U.S. Pat. No. 4,185,437 discloses a building wall panel having an exterior facing of fiberglass reinforced concrete bonded to a support frame formed by metal channel members which are arranged so that their flanges lie against the back side of the exterior facing. A second layer of fiberglass reinforced concrete is applied to both a portion of the rear surface of the exterior facing and the flanges of the channel members at intervals along each channel member.

Accordingly it is a principal object of the present invention to provide large, unitary building wall panels which are faced with thin panels of granite and marble, constitute both the exterior and interior walls of the building, and meet existing fire and insulation codes for commercial structures, thereby overcoming the limitations of the known building wall panels discussed above.

DISCLOSURE OF THE INVENTION

One aspect of the present invention concerns a building wall panel which may serve as both the exterior and interior wall of a building. The wall panel includes an exterior facing of thin granite or marble panels positioned in edge-to-edge relationship to each other. The end portions of C-shaped clips are engaged in spaced apart hole pairs extending into the back surfaces of the facing panels so that the clips project rearwardly from the panels. A backing layer of glass fiber reinforced concrete overlies the rear of the granite or marble panels and the anchor clips and fills the space between the anchor clips and the facing panels so that the anchor clips form the sole interconnection between the facing panels and the reinforced concrete backing layer.

A support frame formed from a plurality of individual, elongate first members interconnected together by transverse second members overlies the rear of the reinforced concrete backing layer. Attachment members extend generally transversely from at least one side of the frame first and/or second members to lie against the rear face of the backing layer. The first and second members of the support frame may include metal channel members, tubular members, I-beams or similar structural components. The attachment members may be composed of the flanges of the channel members or I-beam or may include angle or bar members attached to the first and/or second members or rope or similar lines extending through the first and/or second members.

Additional amounts of glass fiber reinforced concrete of the same composition used to form the backing layer are applied to the attachment members and the adjacent portions of the backing layer to securely bond the support frame to the backing layer and in turn to the granite or marble panels. By this construction, open spaces exist between the members of the support frame which may be filled with insulating material such as rock wool or glass fiber batts or other non-flamable substances.

The glass fiber reinforced concrete backing layer and metal support frame provides sufficient support so that the granite or marble facing panels may be relatively thin, for instance, less than an inch thick. Also, the building panel may be prefabricated in very large sizes, i.e. in lengths of thirty feet or more. The large panels may be rapidly and securely mounted on a building frame structure by welding, bolting or otherwise attaching the metal support frame to the building frame. Moreover, although the building panels may be formed in very large sizes, they are light enough in weight to be conveniently transported from the prefabricating location to the job site and then easily lifted into place.

The building wall panel of the present invention may serve as both an exterior and interior wall partition. A layer of gypsum board, dry wall or similar material is easily and quickly attached to the metal suport frame by any convenient manner, such as by the use of self-tapping screws. The gypsum board may be covered with plaster-faced tape thereby producing a prefabricated, fire-proof wall panel having both exterior and interior surfaces finished thereby greatly reducing the labor required on the construction site.

Another aspect of the present invention includes a method of preforming large building wall panels forming the exterior and interior surfaces of the building with the exterior surface clad with thin sections of granite or marble. The method includes the steps of placing a plurality of presized, thin granite or marble facing panels on a supporting form and then securing anchor clips to the back sides of the facing panels. Next a slurry is formed by mixing together concrete and randomly oriented chopped fiber strands. The slurry is sprayed on the back surfaces of the facing panels and around and over the anchor clips so that anchor clips structurally interconnect the panels to the concrete backing layer.

The method also includes fabricating a metal support frame from a plurality of elongate spaced apart channels or other structural members which are interconnected at their ends by additional structural members. Secondary or attachment members extend outwardly from the primary members to lie either against or closely against the back side of the concrete backing layer. Additional amounts of slurry are sprayed over the anchor members and the adjacent portions of the concrete backing layer to thereby securely bond the metal support frame to the concrete backing layer and thus to the granite or marble facing panels. After the slurry is cured and the panel removed from the form, insulation may be placed over the concrete backing layer between the support frame structural members and then a rear panel attached to the support frame to form a wall panel having both sides finished. The panel may be conveniently mounted on a building frame by interconnecting the metal support frame to elements of the building frame structure.

BRIEF DESCRIPTION OF THE DRAWINGS

The details of one typical embodiment of the present invention will be described in connection with the accompanying drawings, in which:

FIG. 3 is a pictorial presentation of additional typical steps in forming a building wall panel according to the present invention specifically illustrating anchor clips placed in the back surface of the stone panels and a slurry composed of concrete and chopped glass fiber strands being applied to the back surface of the stone panels and to the clips to form a backing layer;

FIG. 4 is a pictorial representation of further typical steps of forming a building wall panel in accordance with the present invention specifically showing the steps of placing the wall panel support frame within the mold and applying additional amounts of slurry to the support frame and adjacent portions of the backing layer;

FIG. 5 is a cross-sectional view of the wall panel support frame illustrated in FIG. 4, and taken substantially along lines 5—5 thereof but with the mold removed;

FIG. 7 is an enlarged cross-sectional view of an anchor clip shown installed in a facing panel and covered by the reinforced concrete backing layer;

FIG. 8 is a fragmentary, isometric view of another typical embodiment of the present invention illustrating an alternative manner of fabricating the support frame;

FIG. 9 is a fragmentary, cross-sectional view of the wall panel illustrated in FIG. 8, and taken substantially along lines 8—8 thereof;

FIG. 10 is a fragmentary, cross-sectional view similar to FIG. 9 illustrating a further typical embodiment of the present invention showing an alternative construction of the wall panel support frame:

FIG. 11 is a fragmentary, isometric view of a further typical embodiment of the present invention illustrating an alternative manner of constructing the support frame; and FIG. 12 is a fragmentary, cross-sectional view of another embodiment of the present invention illustrating an alternative manner of attaching the reinforced concrete backing layer to the facing panels.

BEST MODE OF CARRYING OUT THE INVENTION

Figure 1:
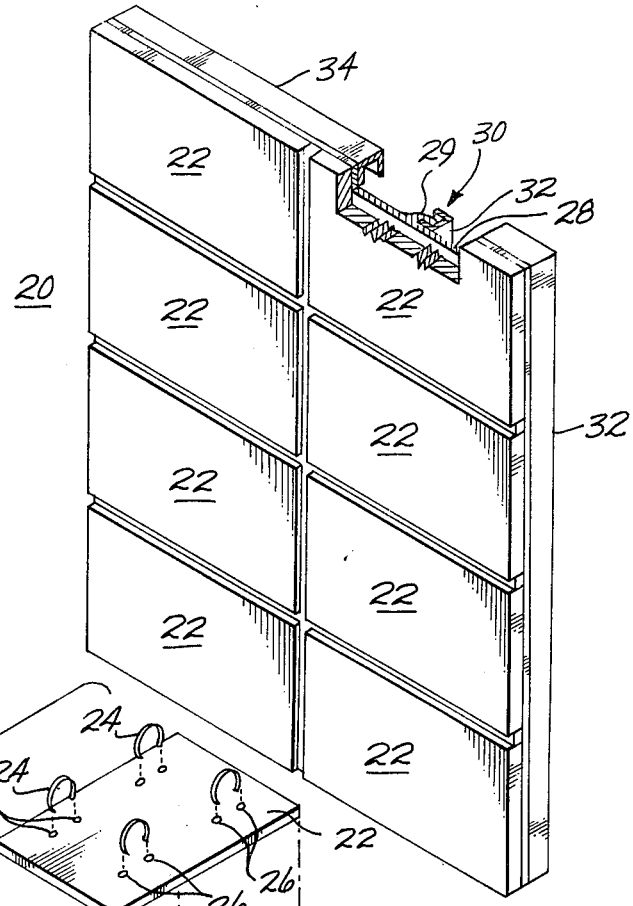
FIG. 1 is a front isometric view of a building wall panel constructed according to the present invention with portions broken away to more clearly illustrate the components of the wall panel.

In one embodiment of the present invention as shown in FIGS. 1 and 5, a building wall panel 20 comprises a plurality of thin, pre-sized granite or marble facing panels 22 arranged in edge-to-edge relationship to each other. Generally C-shaped metal anchor clips 24 are engaged within pairs of holes 26 formed in the back surface of the panels. A thin, glass fiber-strengthened concrete backing layer 28 overlies both the back surfaces of panels 22 and anchor clips 24. A support frame 30 composed of a plurality of individual, elongate primary members 32 and 34 in the form of structural channel members, overlays the rear surface of backing layer 28. Secondary or anchor members 36, in the form of the flanges of the channel members composing the primary members 32 and 34, extend outwardly from the front sides of the primary members to lie against backing layer 28. Additional amounts 29 of glass fiber-strengthened concrete overlies the channel flanges and adjacent portions of backing layer 28 at intervals along the length of the channel members thereby securely bonding support frame 30 to backing layer 28 and to facing panels 22.

Insulation 38, in the form of batts, strips or the like, may be placed between adjacent channel members 32 to overlay the back surface of backing layer 28. Sheets of gypsum board, dry wall or the like, shown at 40, may then be secured to channel members 32 and 34 with appropriate hardware, such as self-tapping screws 42 to cover insulation 38 and form an interior wall. The screws are covered with a layer of plaster-backed tape 44. If desired, a conventional texturized material, not shown, may be applied to the rear surface of gypsum board panels 40 to provide a finished wall surface. Alternatively, other interior finishing materials, such as wood paneling or wallpaper, not shown, may be applied to the gypsum board 40.

Figure 6:
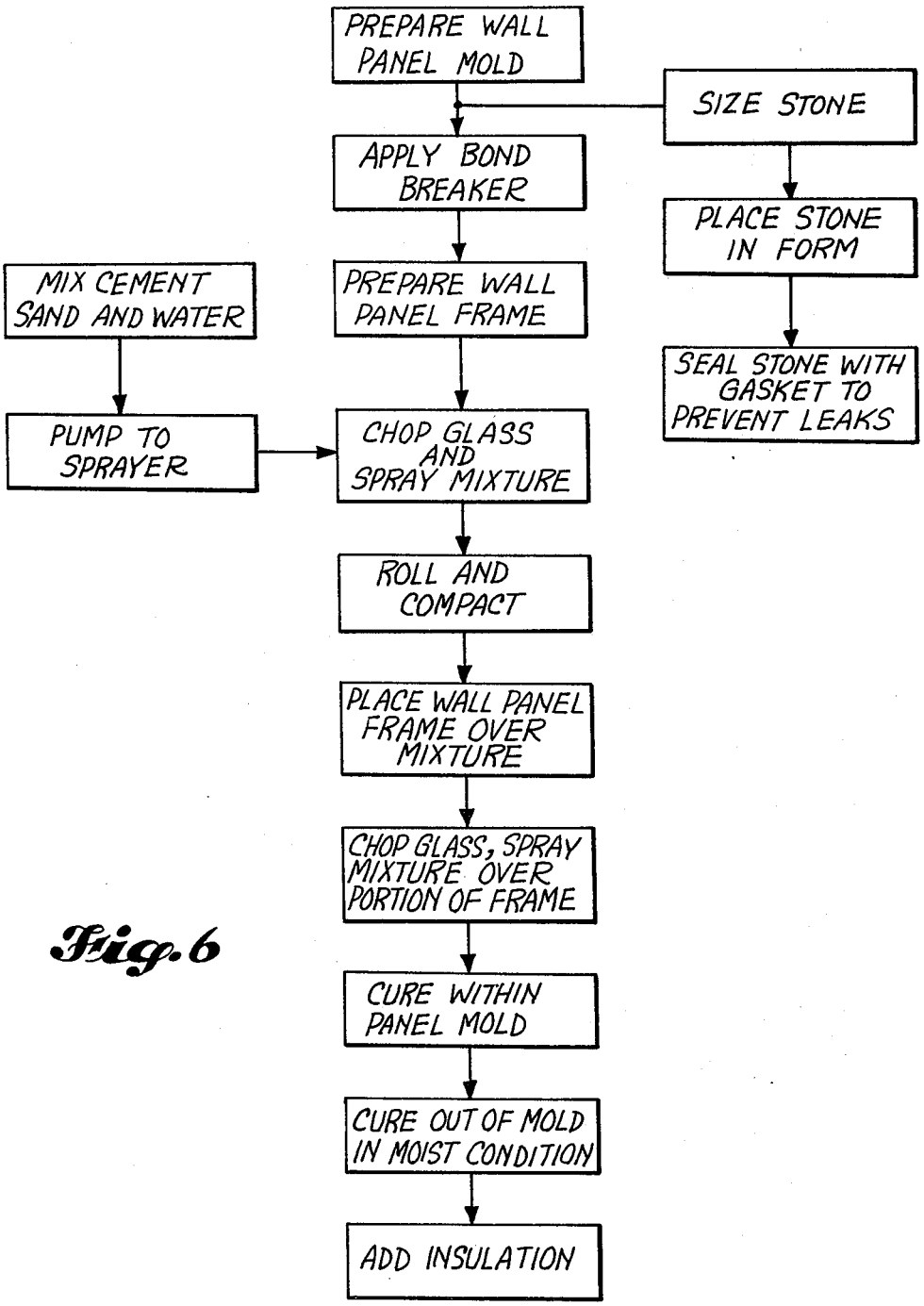
FIG. 6 is a flow diagram illustrating one typical sequence of steps of forming a building wall panel in accordance with the present invention.

Now referring additionally to the flow chart of FIG. 6, and the associated FIGS. 2–4, one typical method of forming a building wall panel in accordance with the present invention will next be described.

A building wall panel mold or form, generally designated as 48, is constructed in the shape of the desired finished building panel. Although building wall panel 20 is illustrated as generally rectangular in shape, it will be understood that other building panel shapes and corresponding wall panel form shapes also may be used in the practice of the present invention. Form 48 is constructed from a flat, smooth support surface 50 and elongate edge members 52 extending around the perimeter of the support surface. Edge members 52 are removably secured to the support surface and detachably secured to each other by any convenient means, such as nails or hinges, where are old per se and do not constitute a part of the present invention. The size of form 48 depends upon the desired size of the finished wall panel 20. In general, the panel form should be slightly longer and slightly wider than the wall panel metal support frame 30 to enable the frame to be snugly inserted within the form during fabrication of the wall panel, as discussed below.

Figure 2:
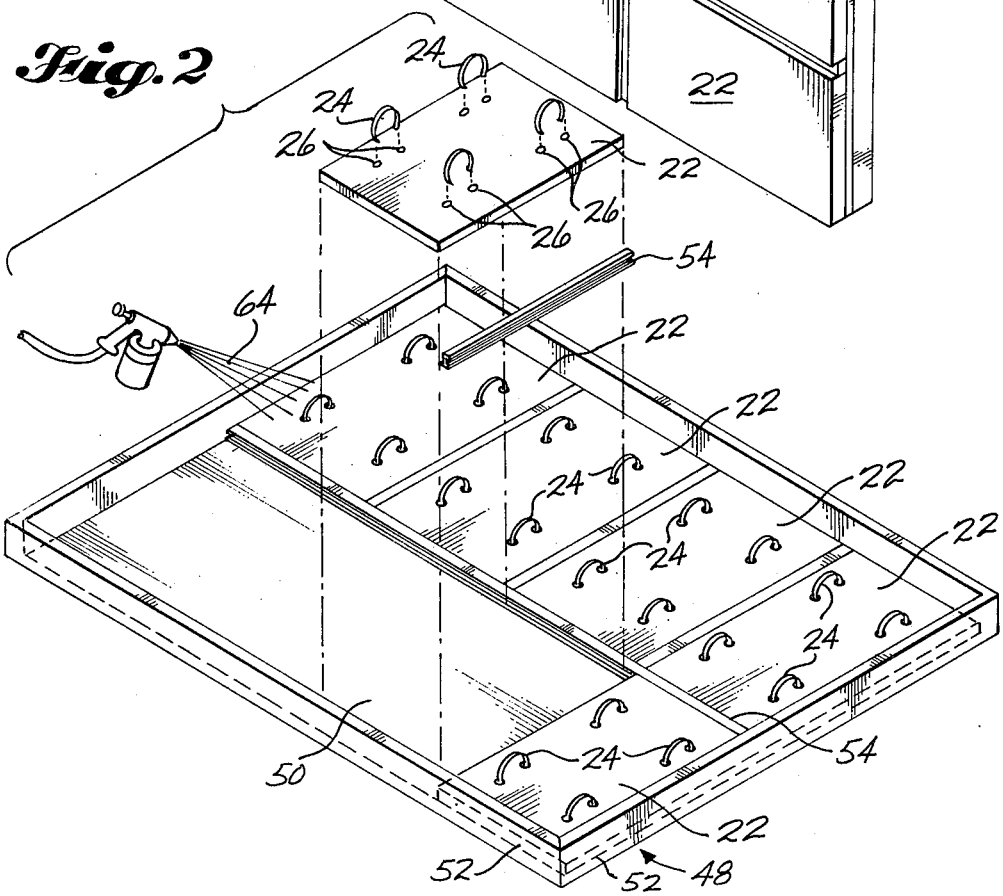
FIG. 2 is a pictorial presentation showing the typical initial steps of constructing a wall panel in accordance with the present invention, wherein granite or marble panels are arranged in adjacent relationship on a mold structure and bond breaker applied to the back surface of the panels.

As illustrated in FIG. 2, a plurality of thin facing panels 22 are arranged face down within form 48 in edge-to-edge relationship to each other. The adjacent edges of the panels are sealed with elongate gaskets 54 to prevent the slurry 55 from which backing layer 28 is composed from running or leaking onto support surface 50 or the faces of panels 20. Gasket 54 may be constructed from rubber, neoprene, or any other suitable sealing material. Also, rather than being formed in individual lengths, gasket 54 may be in putty or caulk form and applied with a pressure gun or other conventional applicator. Ideally, facing panels 22 are composed of granite, marble or other hard stone material which not only is durable and requires low maintainance, but also is very pleasing in appearance. Due to the high structural integrity of wall panel 20 of the present invention, facing panels 22 may be cut relatively thin, i.e. as little as one-half inch, but generally between one-half and one inch in thickness. Although panels 22 are illustrated as being square, they may be cut in other shapes, such as rectangular. Moreover, panels 22 may be cut in different sizes so that either a relatively few or a relatively large number of facing sections are required to cover building wall panel 20.

Additionally referring to FIG. 7, a plurality of anchor clips 24 are next secured to the back surface of facing panels 22 so that the clips extend partially into the surface of the panels and so that they also remain partially spaced above the surface of the panels. The clips are generally semi-circular or C-shaped. Anchor clips 24 may be formed from any rigid, high strength, substantially rust resistant material such as stainless steel flat stock or rod stock. The clip end portions 56 engage within pairs of holes 58 drilled in the rear surface of the panels. The holes 58 are formed at acute angles with respect to the rear surface of panels 22 corresponding to the relative angles of clip ends 56. The distance 60 separating hole pairs 58 is greater than the distance 62 separating clip ends 56 to thereby secure the anchor clips within holes 58. Also, holes 58 are formed in a size and depth such that a substantial portion of the anchor clips 24 remain spaced outwardly of the rear surface of panels 22. The number of anchor clips per panel may be varied in response to the size and thickness of the panels, the type of facing material selected, and the environment in which the building panel will be placed.

As illustrated in FIG. 12, clips 24 may be replaced with pins 61 which are secured within holes 58 with an appropriate adhesive, such as an epoxy resin. Pins 61 include an enlarged circular head 63 which is spaced outwardly of the rear surface of panels 22.

As further illustrated in FIG. 2, after anchor clips 24 have been secured to the rear surface of panels 22, a bond breaker 64 is applied to the rear surface of the panels. The bond breaker 64 prevents the reinforced concrete backing layer 28 from cracking or breaking due to differences in the expansion coefficients of stone panels 22 and the backing layer.

A concrete mixture is then prepared from cement, sand and water. In the presently preferred embodiment, approximately 100 lbs. of cement is mixed with approximately 30 lbs. of sand and enough water, approximately 40 lbs., to make a flowable mixture. It is to be understood that the weight of the sand can be varied from near zero to approximately equal to the weight of the cement without departing from the spirit or scope of the present invention. The cement, sand and water are mixed in a conventional concrete mixer, not shown, and then pumped to a sprayer 66 through line 68. Compressed air is furnished to sprayer 66 through hose 70.

A substantially continuous strand of alkali resistant glass fiber is fed into a conventional chopper mechanism, not illustrated, associated with sprayer 66 from a roll or the like. The glass fiber is chopped into a plurality of short segments and mixed with the concrete in a known manner to form a slurry 55 of concrete and chopped glass fiber strands. The percentage of chopped glass fiber in the slurry may be varied, ideally in the range of from two to six percent of the weight of the concrete as desired to meet the strength requirements of building wall panel 20. The length of the chopped glass fibers also may be varied, but it has been found that a length of about one and one-half inches is satisfactory in most instances. The glass fiber strands must be alkali resistant to prevent breakdown when mixed with the concrete. One type of glass fiber which has been found to be satisfactory is marketed under the name CEM-FIL Alkali Resistant Glass Fiber by CEM-FIL Corporation of Nashville, Tenn. The chopped glass fiber strands have a random orientation with respect to each other when they are mixed with the concrete.

As illustrated in FIG. 3, slurry 55 is sprayed over the backs of panels 22, with care being taken to completely fill the spaces between the underside of anchor clips 24 and the back surfaces of the panels and also to completely cover the anchor clips to thereby form a homogeneous, substantially uniform thickness backing layer 28. Although the thickness of the backing layer may be varied, it has been found that a satisfactory building panel capable of supporting a substantial number of granite or marble pieces on a building may be formed with a thickness as little as three-eighths of an inch; however, the thickness of the backing layer may be increased to increase the strength of building wall panel 20 to meet the needs of a particular application. Also, the thickness of backing layer 28 over anchor clips 24 may be greater than the remainder of the backing layer to strengthen the connection between the granite or marble facing and the backing layer.

If pins 61 are used in place of clips 24, slurry is sprayed over the backs of panels 22 with care being taken to fill the spaces between the underside of pin heads 63 and the back surface of the panels and to completely cover the pin heads to form a homogeneous, substantially uniform thickness backing layer 28. The thickness of backing layer 28 over pins 61 may be greater than the remainder of the backing layer to strengthen the connection between the granite or marble facing and the backing layer.

As the glass fiber reinforced concrete slurry 55 is sprayed onto the back of panels 22 to form backing layer 28, the backing layer is rolled and compacted by rollers 74 or other suitable means. Additional rolling and compacting of the backing layer may be needed prior to curing.

Referring specifically to FIG. 4, a previously assembled building wall panel support frame 30 is placed within form 48 to overly the recently formed backing layer 28. In one preferred form of the present invention, support frame 30 is composed of a plurality of elongate first primary members 32 in the form of channels which are arranged in spaced apart, parallel relationship to each other, in the manner similar to the studs of a conventional wall structure. The ends of primary members 32 are interconnected by transverse, second primary members 34, also in the form of channels. The transverse primary members 34 may be secured to the ends of elongate primary members 32 by any convenient means, such as by rivets or weldments. In the preferred embodiment, primary or channel members 32 and 34 have a width of four inches, but it is to be understood that they may be formed in wider or narrower widths without departing from the spirit and scope of the present invention. Also, ideally channel members 32 are spaced apart from each other typically on sixteen inch centers to facilitate securing standard size interior dry wall or gypsum boards to them. It is to be understood, however, that depending upon the use of building wall panel 20, channel members 32 may be positioned adjacent to each other or separated from each other on centers other than sixteen inches without departing from the scope of the present invention. Moreover, the length of channel members 32 and 34 may be varied depending upon the desired size of building panel 20. If required, diagonal braces or similar reinforcing members, not shown, may be used to reinforce channel members 32 and 34, especially if building panels are formed in large spans, for instance in lengths of over thirty feet.

Channel members 32 and 34 include flanges 36 which extend along both edges of the members. The frame is constructed so that flanges 36 are arranged in a common plane adapted to abut against the rear surface of backing layer 28 at locations between anchor clips 24. The flanges serve as secondary or anchor members for bonding support frame 30 to backing layer 28. Before slurry 55, from which backing layer 28 is composed, has cured, additional quantity or layer 29 of the slurry is sprayed over portions of flanges 36 and adjacent portions of backing layer 28, at intervals along the length of channel members 32 and 34. The additional deposits or layers 29 of slurry 55 have a thickness sufficient to completely cover a portion of flanges 36. It has been found that overlaying the flanges with slurry layers 29 having a width as little as four to six inches at two foot intervals along the length of each of the channel members 32 and 34 is sufficient to securely bond backing layer 28 to support frame 30.

Although support frame 30 is illustrated as assembled from primary members 32 and 34 in the form of structural channels, other structural components may be utilized, such as I-beams, square or rectangular tubing, or Z-sections. Also, although the secondary or anchor members 36 used to bond support frame 30 to backing layer 28 are shown as composed of the flanges of primary members 32 and 34, the anchor members may be of other constructions. For instance, as illustrated in FIGS. 8 and 9, the anchor members may be in the form of angle-shaped tabs 36' having one leg overlapping primary members 32 and/or 34 and the other leg disposed parallel to backing layer 28. The tabs 36' may be riveted, bolted, welded or otherwise secured to the primary members. Additional layers or amounts 29' of slurry 55 are sprayed over the tabs 36' in a manner similar to that discussed above.

As illustrated in FIG. 11, the anchor member may also be in the form of a bar 36'' bent into right-angle shape with one leg of the bar welded or otherwise affixed to primary members 32 and/or 34 and the other leg aligned parallel to backing layer 28. Additional amounts or layers 29'' of slurry 55 are sprayed over bars 36''. The bars may be formed from round or square stock or other cross-sectional shapes.

In a further typical form of the present invention, as illustrated in FIG. 10, anchor members 36''' are composed of lengths of metal strips, wire, rods or similar structural members which extend through transverse openings 78 formed in primary members 32 and/or 34. The ends of anchor members 36''' preferrably abut against the rear side of backing layer 28. As discussed above relative to flanges 36, tabs 36' and bars 36''', preferrably additional amounts 29''' of slurry 55 are sprayed over the end portions of anchor members 36''' and the adjacent portions of backing layer 28 to securely attach support frame 30 to the backing layer. It is to be understood that in addition to the particular forms of the attachment means or anchor members 36, 36', 36'' and 36''' discussed herein, anchor members of other shapes and forms are within the scope and spirit of the present invention.

After the additional deposits 29 of slurry 55 have been applied both over flanges 36 and adjacent portions of backing layer 28, building wall panel 20 is allowed to cure in form 48 for a period of approximately twelve hours. After that time, form edge members 52 are detached from each other and removed from support surface 50, and the building panel is allowed to cure for approximately an additional seven days. During this time, the building wall panel is maintained in a moist environment, such as by intermittently spraying the wall panel with water. It is to be understood that the curing times mentioned above are only approximate and may be varied somewhat without departing from the spirit and scope of the present invention.

After building wall panel 20 has been completely cured, if required, a conventional caulking material, not shown, may be applied between adjacent edges of granite or marble panels 22, especially if the panels are positioned angularly to each other rather than in a flat plane as shown in FIG. 1.

Next, as illustrated in FIGS. 1 and 5, insulation 38 in the form of batts, rolls or the like may be applied over the rear surface of backing layer 28 between adjacent primary members 32 which stand out rearwardly of the backing layer. The insulation 38 may be held in place by any convenient means, for instance, by gluing a plurality of pins 80 to backing layer 28 and then securing the blanket of insulation thereto by snap-on washers 82 or the like. Applying insulation 38 at the factory where the building wall panel is fabricated eliminates the often difficult and time-consuming task of applying the insulation at the job site after the wall panel has been installed. However, if desired, the insulation can be installed on backing layer 28 at the job sight in a conventional manner.

The completed wall panel 20 may be secured to the exterior or interior of the structure by any convenient means, such as by riveting, bolting or welding the top, bottom and/or sides of the wall panel, as formed by primary members 32 and 34, to the building frame. Adjacent wall panels 20 may be secured to each other by extending rivets, bolts, or other conventional fasteners, extending through abutting primary members 32 or 34.

With reference to FIGS. 1 and 5, before panel 20 is mounted on a building structure, the rear or inside surface of the wall panel may be finished by securing sheets of dry wall or gypsum board 40 to primary members 32 and 34 by the use of self-tapping screws 42 or the like. If the self-tapping screws are used, a thin layer of plaster-backed tape 44 may be applied at the edges between adjacent sheets of gypsum board 40, as well as over each row of the self-tapping screws to form a smooth surface. If desired, a final layer of interior facing material, not shown, such as texturized paint, wallpaper or the like may be applied over gypsum board 40. Although the gypsum board 40 may be fastened to panels 20 at the factory thereby additionally reducing the labor required on the job site, the gypsum board also may be mounted on panels 20 at the job site. Once panels 20 have been mounted on a building structure, the seam existing between adjacent panels may be covered with plaster-backed tape 44 and then the final layer of interior facing material, not shown, applied.

There has been described a preferred embodiment of a building panel having granite or marble facing and a method of making the building panel in accordance with the present invention. The terms granite and marble have been used interchangeably since the present invention is believed to solve problems which have existed with respect to the use of both of these natural stones as either exterior or interior wall coverings. It will be appreciated by those skilled in the art of the present invention that the teachings of this invention may be used to advantage in any situation where it is desired to provide a large, relatively lightweight building panel with a facing of natural stone material, such as marble or granite, and also where the wall panel is finished on both of its sides. Therefore, it is to be understood by those skilled in the art that various changes and omissions may be made in the form and detail of the description of the present invention set forth above without departing from the spirit or central characteristics of the invention. The particular embodiment of the building wall 20, described above, is therefore to be considered in all respects as illustrative and not restrictive, i.e. the scope of the present invention is as set forth in the appended claims rather than being limited to the example of the building wall panel 20 set forth in the foregoing description.

What is claimed:

1. A building wall panel, comprising:
(a) a plurality of thin granite or marble panels positioned in adjacent relationship to each other;
(b) anchor means mounted in the back surfaces of each of said granite or marble panels and extending rearwardly therefrom;
(c) a backing layer of glass fiber reinforced concrete overlying the rear of said granite or marble panels and encasing said anchor means, said fiber reinforced backing layer initially being of slurry composition and upon solidifying said reinforced backing layer supporting said facing panels through said anchor means;
(d) support frame means overlying the back side of said backing layer opposite said granite or marble panels at locations separate from the locations of said anchor means, said support frame means formed from a plurality of metal first members having attachment means extending outwardly therefrom; and
(e) additional amounts of glass fiber reinforced concrete overlaying portions of said attachment means and adjacent portions of said backing layer, said additional amounts of glass fiber reinforced concrete being initially of slurry composition and upon solidifying said additional amounts of glass fiber reinforced concrete securely bonding said support frame means to said solidified backing layer.

2. The building wall panel according to claim 1, wherein said additional amounts of glass fiber reinforced concrete overlying portions of said attachment means and said backing layer constitute the only connection of the backing layer to said support frame.

3. The building wall panel according to claim 1, wherein said granite or marble panels are less than one inch thick.

4. The building wall panel according to claim 1 or 3, wherein the thickness of said backing layer is substantially equal to or less than the thickness of said granite or marble panels.

5. The building wall panel of claim 1, wherein said anchor means alone mount said granite or marble panels on said backing layer.

6. The building wall panel of claim 1, wherein said glass fiber reinforced concrete comprises a mixture of concrete and randomly oriented chopped strands of alkali resistant glass fiber.

7. The building wall panel of claim 6, wherein said chopped strands of glass fiber are approximately one and one-half inches in length.

8. The building wall panel according to claim 6, wherein the glass fibers comprise from between two to six percent of the weight of said mixture.

9. The building wall panel according to claim 1, wherein:
said support frame means comprises a plurality of individual, elongate, first members interconnected together by transverse second members; and
said attachment means extending generally transversely from at least one side of said first and/or second members.

10. The building wall panel according to claim 9, wherein said attachment means comprise bar members formed in an angle shape attached to said first and/or second members to overlie portions of the side of said backing layer opposite said granite or marble panels.

11. The building wall panel according to claim 9, wherein said attachment means comprise lines extending outwardly from said first and/or second members which at least portions of said lines overlying the side of said backing layer opposite said granite or concrete panels.

12. The building wall panel of claim 9, wherein said attachment means comprise flanges on at least one side of said first and/or second members overlying a portion of the side of said backing layer opposite said granite or marble panels.

13. The building wall panel according to claim 12, wherein said flanges are integrally formed with said first and/or second members.

14. The building wall panel according to claim 12, wherein said attachment means comprise angle members attached to said first and/or second members to overlie a portion of the back side of said backing layer opposite said granite or marble panels.

15. A method of forming a building panel from a plurality of relatively thin, pre-sized panels of selected facing materials such as granite or marble, comprising the steps of:
(a) placing the panels of the selected facing material face down on a support;
(b) securing anchor means to the backs of said facing panels;
(c) covering the backs of said panels and encasing said anchor means with a relatively thin layer of slurry formed from glass fiber reinforced concrete such that when the concrete slurry is cured, said anchor means interconnected said facing panel and said concrete layer;
(d) placing on said concrete layer a wall panel support frame formed from a plurality of primary members and placing in said concrete layer attachment means extending outwardly from said primary members
(e) positioning said wall panel support frame on said concrete layer to locate said primary and attachment means on the side of said concrete layer opposite said granite or marble panels at locations separate from the locations of said anchor means;
(f) placing additional amounts of said slurry over at least portions of said attachment means means and adjacent portion of said concrete layer; and
(g) curing said slurry and removing the completed building wall panel from the support.

16. The method of claim 15, further including the step of rolling and compacting said slurry on the back surfaces of the panels of facing material after spraying.

17. The method of claim 15, further including forming the slurry from concrete and randomly oriented chopped glass fiber strands.

18. The method of claim 17, wherein the step of forming said slurry comprises mixing said randomly oriented glass fiber strands with the concrete such that the weight of said strands are equal to between two and twelve percent of the weight of the concrete.

19. A method of mounting relatively thin granite or marble facing panels on a building, comprising the steps of:
(a) placing a plurality of granite or marble facing panels generally adjacent to each other in a support form;
(b) mounting anchor means on the backs of said facing panels;
(c) forming a slurry of concrete and randomly oriented chopped glass fiber strands;

(d) covering the backs of said panels and encasing said anchor means with a backing layer of said slurry such that when said slurry is cured, said anchor means interconnect said facing panels and said backing layer;

(e) placing on said backing layer a wall panel support frame formed from a plurality of primary members and attachment means means extending outwardly from at least one side of said primary members;

(f) locating said panel support frame to avoid positioning said primary and attachment means at the locations of said anchor means;

(g) spraying additional amounts of said slurry over portions of said attachment means and adjacent portions of said slurry backing layer; and (h) mounting said building wall panel support frame on a building to clad said building.

20. The method of claim 19, wherein the step of placing the wall panel support frame on said backing layer includes abutting portions of said attachment means means against said backing layer.

21. The method of claim 19, wherein the step of forming said slurry comprises mixing the randomly oriented glass fiber strands with the concrete such that the weight of said strands are to equal to between two percent and six percent of the weight of the concrete.

* * * * *

UNITED STATES PATENT AND TRADEMARK OFFICE

CERTIFICATE OF CORRECTION

PATENT NO. : 4,453,359

DATED : June 12, 1984

INVENTOR(S) : Ralph C. Robinson

It is certified that error appears in the above-identified patent and that said Letters Patent is hereby corrected as shown below:

| | |
|---|---|
| Column 6, line 44 | "maintainance" should be --maintenance--. |
| Column 12, line 2 | "which" should be --with--. |
| Column 12, line 44 | delete "means", second occurrence. |
| Column 12, line 45 | "portion" should be --portions--. |
| Column 13, line 10 | delete "means", second occurrence. |
| Column 14, line 9 | delete "means", second occurrence. |

Signed and Sealed this

*Twentieth* Day of *November 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,453,359

DATED : June 12, 1984

INVENTOR(S) : Ralph C. Robinson

It is certified that error appears in the above-identified patent and that said Letters Patent is hereby corrected as shown below:

Column 8, line 22 "overly" should be — overlay —.

Column 12, line 39 after "primary" add — members —.

Signed and Sealed this

*Fifth* Day of *March 1985*

[SEAL]

*Attest:*

DONALD J. QUIGG

*Attesting Officer* *Acting Commissioner of Patents and Trademarks*